US012655493B2

(12) United States Patent
Babineau et al.

(10) Patent No.: US 12,655,493 B2
(45) Date of Patent: Jun. 16, 2026

(54) FORGED GRINDING BALLS FOR SEMI-AUTOGENOUS GRINDER

(71) Applicant: MAGOTTEAUX INTERNATIONAL S.A., Vaux-sous-Chèvremont (BE)

(72) Inventors: Marc Babineau, Beaufays (BE); Michel Bonnevie, Bovesse (BE)

(73) Assignee: Magotteaux International S.A., Vaux-sous-Chévremont (BE)

( * ) Notice: Subject to any disclaimer, the term of this patent is extended or adjusted under 35 U.S.C. 154(b) by 846 days.

(21) Appl. No.: 17/789,728

(22) PCT Filed: Jan. 14, 2021

(86) PCT No.: PCT/EP2021/050656
§ 371 (c)(1),
(2) Date: Jun. 28, 2022

(87) PCT Pub. No.: WO2021/144347
PCT Pub. Date: Jul. 22, 2021

(65) Prior Publication Data

US 2023/0071728 A1 Mar. 9, 2023

(30) Foreign Application Priority Data

Jan. 16, 2020 (BE) ..... 20205031

(51) Int. Cl.

| | |
|---|---|
| ***C21D 9/36*** | (2006.01) |
| ***C21D 1/18*** | (2006.01) |
| ***C22C 38/02*** | (2006.01) |
| ***C22C 38/04*** | (2006.01) |
| ***C22C 38/18*** | (2006.01) |
| ***C22C 38/44*** | (2006.01) |
| ***C22C 38/58*** | (2006.01) |

(52) U.S. Cl.
CPC ..... *C21D 9/36* (2013.01); *C21D 1/18* (2013.01); *C22C 38/02* (2013.01); *C22C 38/04* (2013.01); *C22C 38/18* (2013.01); *C22C 38/44* (2013.01); *C22C 38/58* (2013.01); *C21D 2211/001* (2013.01); *C21D 2211/002* (2013.01); *C21D 2211/008* (2013.01); *C21D 2211/009* (2013.01)

(58) Field of Classification Search
CPC ..... C21D 9/36
See application file for complete search history.

(56) References Cited

U.S. PATENT DOCUMENTS

| | | | |
|---|---|---|---|
| 3,961,994 | A | 6/1976 | Thome |
| 4,043,842 | A | 8/1977 | Joiret |
| 4,221,612 | A | 9/1980 | Thome |

FOREIGN PATENT DOCUMENTS

| | | | |
|---|---|---|---|
| CN | 102876961 A | * | 1/2013 |
| CN | 103710646 A | | 4/2014 |

OTHER PUBLICATIONS

Weber, K. and Regener, D., 2002. Microstructure and magnetic properties of white cast irons for grinding balls. Materialwissenschaft Und Werkstofftechnik, 33(10), pp. 599-605. (Year: 2002).*
English machine translation of Weber, K. and Regener, D., 2002. Microstructure and magnetic properties of white cast irons for grinding balls. Materialwissenschaft Und Werkstofftechnik, 33(10), pp. 599-605. (Year: 2002).*
English machine translation of CN 102876961 A of Li (Year: 2013).*
International Search Report and Written Opinion of the International Searching Authority from the European Patent Office, in PCT/EP2021/050656 dated Feb. 12, 2021, which is an international application corresponding to this U.S. application.
Blickensderfer, R. et al.; "Evaluation of commercial US grinding balls by laboratory impact and abrasion tests"; obtained from Minerals & Metallurgical Processing; May 1989.
Michaud, David; "SAG Mill Ball Size Evaluator, Evaluation Factors, Calculation Diameter" obtained from 911 Metallurgical, https://www.911metallurgist.com/blog/sag-mill-ball-size-evaluator-evaluation-factors, Sep. 8, 2013.
Palchikoff, Keith; "SAG Mill—Semi-Autogenous Grinding Mill" obtained from http://ffden-2.phys.uaf.edu/211_fall2002.web.dir/Keith_Palchikoff/grinding_mill_2.html.

* cited by examiner

*Primary Examiner* — Jophy S. Koshy
(74) *Attorney, Agent, or Firm* — Kolitch Romano Dascenzo Gates LLP

(57) ABSTRACT

An improved grinding ball may include a carbon content of 1.1 to 1.4 wt %, a chromium content of 10 to 14 wt %, a manganese content of 0.8 to 1.5 wt %, a silicon content of 0.6 to 1 wt %, a molybdenum content of less than 1 wt %, a nickel content of less than 1 wt %, any impurities with a total content of less than 0.5 wt %, the balance to obtain 100% being iron. The grinding ball includes a discrete distribution of chromium carbides as opposed to a network distribution.

9 Claims, 8 Drawing Sheets

FORGED GRINDING BALLS FOR SEMI-AUTOGENOUS GRINDER

FIELD

The present disclosure relates to cast iron grinding balls with a high chromium content, designed for semi-autogenous grinding. It also relates to the method for manufacturing said balls.

INTRODUCTION

In the mining industry, grinding is designed to release the valuable particles of metallic minerals from the gangue, which is made up of worthless, but often highly abrasive minerals. Factories consist of crushing stations, grinding stations, then sections for concentrating, usually by flotation, sulfide ores such as copper or lead and zinc, which are often associated.

In the grinding section of these factories, the current method is based on a semi-autogenous rotary grinder and one or several rotary ball grinders. This kind of process line can be duplicated depending on the desired throughput or the types of ores that exist in the mine.

The semi-autogenous grinder is characterized by an original design. The diameter is very large, generally of more than five meters, with a proportionally short length. It is characterized by a length-to-diameter ratio that is usually of less than 1, preferably comprised between 0.5 and 1. The supply of ores, done continuously, comes directly from the mine or from a crushing section. A variable quantity of water is added to the blocks of ores of different dimensions. The throughputs are very high, often significantly greater than 1000 tons per hour.

These grinders are protected by liners allowing raising of the material to be ground. FIGS. 1A and 1B show a semi-autogenous grinder 1. These grinders comprise liners 2 with protruding parts called lifters 3, which allow very intensive raising. When the grinder is rotating about its horizontal axis, the pieces of rocks are raised and fall back on the bed of rocks in the lower part. Furthermore, through a relative movement between blocks and the impacts related to the rotation, the size of the material is significantly reduced, which explains the term "autogenous grinding."

For some very hard ores, the size of the rocks is no longer reduced once they reach a certain critical size and they thus accumulate in the grinder, decreasing the effectiveness thereof. To limit this effect, a small quantity of large balls is added, generally occupying between 8 and 12% of the available volume in the grinder. These balls have dimensions greater than 100 mm, often 125 mm and sometimes 160 mm, and weigh up to 16 kg each. Driven by the lifters, they will crash, after falling from 5 to 7 m, onto the rocks and help crush hard and difficult to grind blocks, in the best cases. This methodology corresponds to the name "semi-autogenous grinding."

Fine material can exit the grinder through a discharge grate, and is sent to the following treatment steps.

The grinding balls used in semi-autogenous grinders must have good impact resistance as well as good wear resistance. In fact, the balls used in semi-autogenous grinders are subject to significant wear by abrasion and to many impacts. This is due to the combined action of very hard minerals in the form of large blocks, often having sharp edges, and destruction by breaking and spalling, related to the impact conditions inside this equipment. The smaller worn or broken balls are no longer effective in their role of crushing blocks of critical size that accumulate in the grinder. These small balls exit the grinder through open orifices in the discharge grate of the semi-autogenous grinder.

To best combine the properties of wear resistance and impact resistance, two types of balls are generally used.

On the one hand, there are weakly alloyed carbon steel balls. These steels comprise, by weight, from 0.4 to 0.9% carbon, less than 1% manganese, chromium and silicon, as well as elements in smaller quantities such as molybdenum, vanadium, titanium, niobium, as well as more harmful impurities such as sulfur and phosphorus, for example. These balls are shaped by forging a bar derived from casting.

On the other hand, there are balls made from chromium cast iron, with a chromium content greater than or equal to 5% by weight, which are shaped directly by casting in a sand or metal mold. These alloys have the characteristic of including chromium carbides, referred to as primary carbides, which are formed during solidification upon casting. These are carbides of the $M_7C_3$ type. During solidification, austenite cells free of carbides appear first. Next, network carbides form around these austenite cells at the eutectic point. FIGS. 2A and 2B typically show the distribution of the carbides in a cast iron shaped by casting in a mold. FIG. 2A shows the network distribution of the carbides 5 that is formed between the austenite dendrites during solidification. FIG. 2B schematically shows these same network carbides. A network of carbides 5 can thus be seen, distributed within a matrix 4 devoid of the quasi-continuous network of primary carbides. These carbides make it possible to improve the wear properties compared to the aforementioned steels, but their non-uniform and coarse distribution deteriorates the impact resistance properties compared to these same steels.

Shaping by forging on the chromium cast iron alloys has always been banned because these coarse carbides initiate crack formation during forging. Weakly alloyed steels, devoid by definition of chromium carbides, do not have this problem, which has allowed the development of shaping methods by forging on these grades.

Thus, according to the prior art, there are, on the one hand, weakly alloyed steels that have good impact resistance and average wear resistance, and on the other hand, high chromium cast irons that have a good wear resistance but an average impact resistance.

As previously mentioned, after the grinding section, there is a concentrating section, generally by flotation, for the sulfide ores such as copper or lead and zinc. The chromium enrichment in the cast iron balls allows optimization of the flotation steps that take place during recovery in this section. The presence of chromium allows a better quality pulp to be obtained with, as a corollary, a reduction in the quantity of reagent that is necessary. The chromium content must, however, be perfectly dosed to avoid a cost overrun related to the addition of chromium. In parallel, the carbide content and therefore carbon content in the cast irons must also be perfectly controlled to avoid embrittlement of the material due to excess carbides.

Forged grinding balls in chromium white cast iron with different carbon and chromium contents are known from documents U.S. Pat. Nos. 4,221,612, 3,961,994 and CN 103,710,646.

Grinding balls forged from chromium white cast iron obtained from a bar manufactured by chill casting or by continuous casting are thus known from document U.S. Pat. No. 4,221,612. The grinding balls have a carbon content by weight comprised between 1 and 3% and a chromium content comprised between 2 and 8%.

Grinding balls forged from white cast iron with a high chromium content obtained from a bar manufactured by continuous casting are known from document U.S. Pat. No. 3,961,994. The grinding balls have a carbon content by weight comprised between 1.5 and 3% and a chromium content comprised between 8 and 25%.

Grinding balls obtained by molding are known from document CN 103,710,646. The grinding balls have a carbon content by weight comprised between 1.7 and 2.15% and a chromium content comprised between 5.3 and 8%.

SUMMARY

The present disclosure proposes a grinding ball having the advantages of weakly alloyed steels as well as the advantages of chromium cast irons, that is to say, having both good impact resistance and good wear resistance while having a chromium content that is optimized for the concentrating section. For this purpose, according to the present disclosure, the composition and the manufacturing method are optimized. The present disclosure proposes this type of ball in particular for use in the context of a semi-autogenous grinding method.

The present disclosure relates to a grinding ball comprising, by weight:

a carbon content comprised between 1.1 and 1.4%,
a chromium content comprised between 10 and 14%,
a manganese content comprised between 0.8 and 1.5%,
a silicon content comprised between 0.6 and 1%,
a molybdenum content of less than 1%,
a nickel content of less than 1%,
any impurities with a total content of less than 0.5%,
the balance to obtain 100% being iron, said grinding ball comprising a discrete distribution of chromium carbides as opposed to a network distribution, which gives the ball improved impact resistance properties.

The carbon content is kept in the range of 1.1-1.4% by weight to obtain the sufficient, but not excessive quantity of carbides to avoid embrittlement of the ball. Jointly, the chromium content is kept in the range of 10-14% to obtain a sufficiently chromium-rich matrix for better recovery after grinding while avoiding a cost overrun related to the addition of chromium. Preferably, the carbon content and the chromium content are correlated according to the following inequalities:

$$2.55 \leq Cr - 5.42*C \leq 7.67 \text{ and } 41.76 \leq Cr + 28.66*C \leq 53.69.$$

Furthermore, the carbides are finely distributed within the microstructure of the ball. Preferably, they have an equivalent diameter of less than 100 μm, more preferably less than 50 μm and still more preferably less than 20 μm.

The microstructure comprises a matrix in which the chromium carbides are distributed. Preferably, the microstructure comprises martensite with a percentage greater than 50%, residual austenite with a percentage comprised between 7 and 25%, a total fraction of perlite and bainite comprised between 2 and 10%, the balance being made up of chromium carbides with a percentage of less than or equal to 22%.

The present disclosure also relates to the method for manufacturing this grinding ball comprising the following steps:

Producing, by continuous casting, a bar having the aforementioned chemical composition to obtain the discrete distribution of chromium carbides, Shaping the bar by deforming it in one or several steps to obtain a blank having the shape of the grinding ball, Heat treatment in one or several cycles of the blank to obtain the grinding ball with a primarily martensitic microstructure.

LEGEND

Figure 1A:
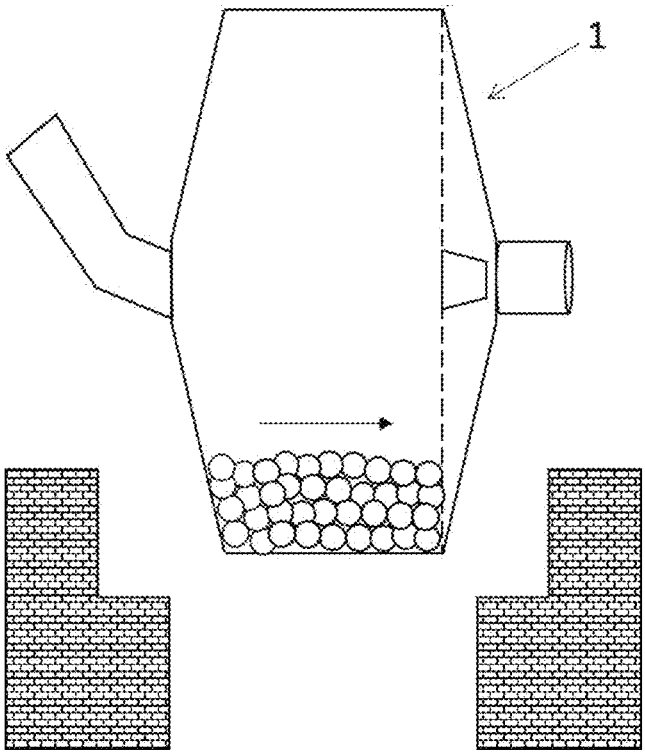
FIG.1A (Prior Art)
FIG. 1A shows a schematic view of a semi-autogenous grinder.
Figure 1B:
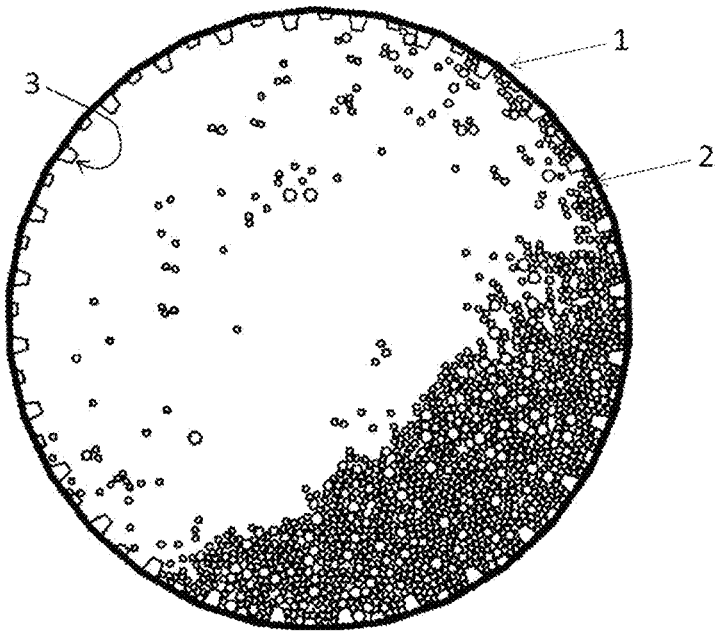
FIG.1B (Prior Art)
FIG. 1B illustrates the grinding mechanism within the semi-autogenous grinder.

1. Semi-autogenous grinder
2. Liner
3. Lifter
4. Matrix
5. Carbide
6. Induction furnace
  a. for casting
  b. for heating
7. Arc furnace
8. Ladle
9. Chill mold
10. Extraction system
11. Magnetic stirring system
12. Bar
  a. Liquid part
13. Cutting equipment
14. Pusher-type furnace
15. Rolling mill
16. Forging press
  a. Stationary part
  b. Moving part
17. Knife
18. Slug
19. Grinding ball

DETAILED DESCRIPTION

The present disclosure relates to the method for manufacturing grinding balls and to the grinding balls more specifically designed for use in a semi-autogenous grinder. Typically, it involves balls having a diameter comprised between 90 mm and 150 mm.

The grinding ball is made from a high chromium cast iron having the following composition by weight:

- a carbon content comprised between 1 and 2%,
- a chromium content comprised between 7 and 16%,
- a manganese content comprised between 0.5 and 3%,
- a silicon content comprised between 0.2 and 1.5%,
- a molybdenum content of less than 1.5%,
- a nickel content of less than 1.5%,
- any impurities/contaminations such as vanadium, niobium and titanium with a total content of less than 0.5%,
- the balance to obtain 100% being iron.

Preferably and as claimed, it has the following composition by weight:

- a carbon content comprised between 1.1 and 1.4%,
- a chromium content comprised between 10 and 14%,
- a manganese content comprised between 0.8 and 1.5%,
- a silicon content comprised between 0.6 and 1%,
- a molybdenum content of less than 1%,
- a nickel content of less than 1%,
- any impurities such as vanadium, niobium and titanium with a total content of less than 0.5%,
- the balance to obtain 100% being iron.

More preferably, it has the following composition by weight:

- carbon: 1.2%,
- chromium: 12%,
- manganese: 1.1%,
- silicon: 0.8%,
- molybdenum: <1.5%,
- nickel: <1.5%,
- any impurities with a total content of less than 0.5%,
- the balance to obtain 100% being iron.

Figure 9:
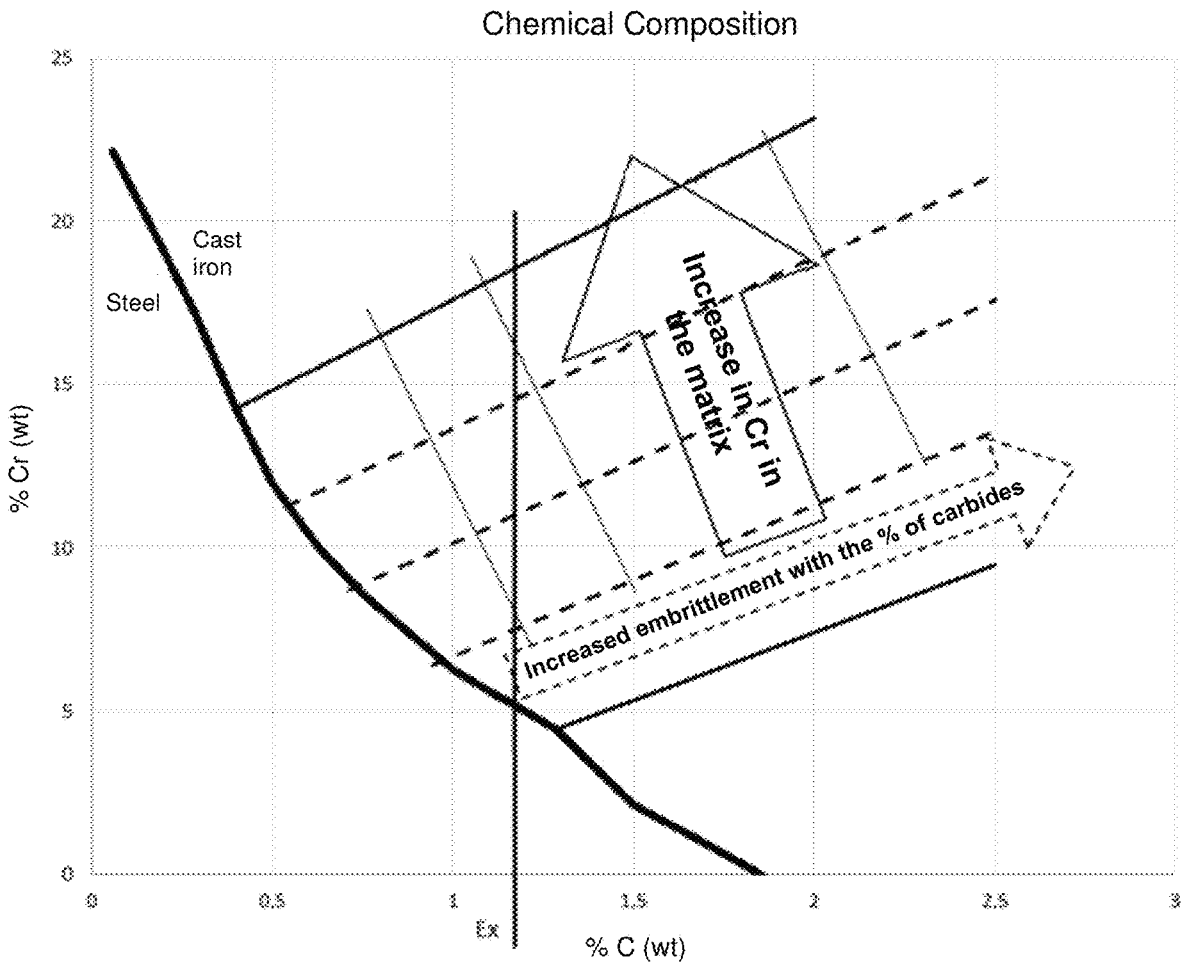
FIG. 9 illustrates the joint effect of carbon and chromium on the composition of the matrix and the carbon content.

According to the present disclosure, the chromium content and the carbon content are jointly and respectively kept in the range of 10-14% and 1.1-1.4%. Indeed, as shown schematically in FIG. 9, the carbon content and the chromium content are closely linked. The dotted lines, called co-nodes, are lines representing alloys that have the same matrix composition, that is to say, inter alia, the same chromium content in the matrix. Going from one co-node to another by following the solid arrow reflects an increase in the chromium content in the matrix. Conversely, moving along a co-node, the composition of the matrix remains unchanged, but the carbide content evolves and increases as one moves toward the dotted arrow. Indeed, nearly perpendicularly to the co-nodes, lines of equal carbide content are also shown in FIG. 9. By following a line of equal carbide content, the chromium carbide content is unchanged, but as one moves parallel to the solid arrow, the matrix becomes richer in chromium. The lines of equal carbide content and the co-nodes are not parallel to the C and Cr axes. This means that modifying only the C content or only the Cr content will modify the carbide content and also the chromium content in the matrix. One can thus see, in FIG. 9, that with an equal carbon content in the overall composition of the material in example 'Ex', an increase in the chromium content in the overall composition is accompanied by an increase in the chromium content in the matrix and an increase in the carbide content in the matrix. There is therefore cause to find a compromise between the carbon and chromium contents to obtain the sufficient, but not excessive, quantity of carbides and chromium in the matrix. This compromise is found with the aforementioned ranges of 10-14% and 1.1-1.4% by weight for chromium and carbon, respectively. Preferably, the carbon and chromium contents are correlated according to the two inequalities: $2.55 \leq Cr-5.42*C \leq 7.67$ and $41.76 \leq Cr+28.66*C \leq 53.69$.

In terms of microstructures, the ball according to the present disclosure has a primarily martensitic microstructure, that is to say, with a martensite percentage greater than 50%, with a fine and uniform distribution of chromium carbides, called primary carbides, of the $M_7C_3$ type, within the matrix. Preferably, the primary carbides have an equivalent diameter of less than 100 μm, more preferably less than 50 μm and still more preferably less than 20 μm. The carbides are not perfectly circular. To calculate the equivalent diameter, the area A of the carbides is measured by image analysis and an equivalent diameter $D_{eq}$ for a circular carbide of equal area is determined based on the formula $D_{eq}=2*(A/\pi)^{1/2}$. The mean of the equivalent diameters is obtained based on measurements taken on at least three images. Typically, for the carbide size range according to the present disclosure, the measurements are for example taken on images having a size of 660 μm×495 μm. The size of the carbides is substantially uniform between the surface and the core of the ball with the manufacturing method described hereinafter.

The manufacturing method of the grinding ball according to the present disclosure comprises the following steps:

- A step for continuous casting of the bar, which will also be described as a billet, with the aforementioned composition allowing this fine distribution of primary carbides to be obtained,
- A step for shaping the bar by deformation in one or several steps, to obtain a blank in the shape of the grinding ball,
- A step for heat treatment of the blank, in one or several cycles, to obtain the grinding ball with the primarily martensitic microstructure.

Figure 5:
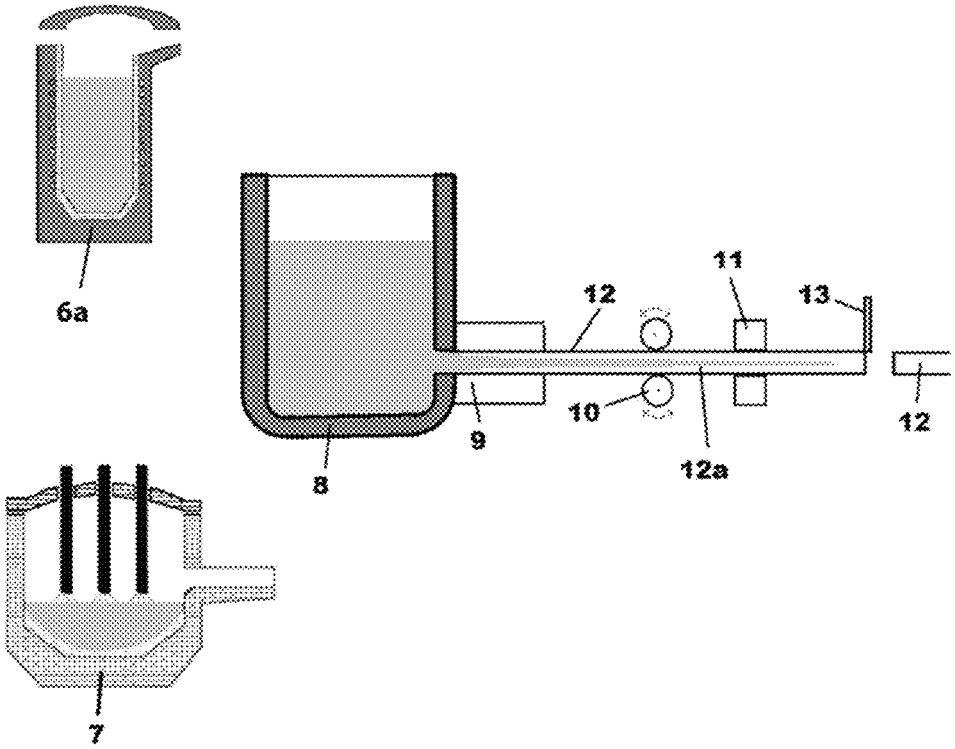
FIG. 5 is a schematic illustration of the continuous casting step implemented in the method according to the present disclosure.

The continuous casting step is illustrated in FIG. 5, more specifically for continuous horizontal casting. This technique favors solidification with fine grains by rapid cooling in a chill mold 9 cooled by circulating water.

The equipment comprises a liquid metal reservoir, called ladle 8, used as a buffer between the melting equipment, which is an induction furnace 6*a* or an arc furnace 7, and the continuous horizontal casting. The solidification (the liquid part is referenced 12*a*) is initiated in the chill mold 9 in copper alloy that combines good heat conductivity and good wear resistance by friction, optionally followed by a graphite part encompassed in a copper enclosure cooled with water and optionally followed by secondary cooling by water jets. The internal morphology of this copper or composite chill mold accounts for the specific contraction related to the composition of the alloy, which will go from the liquid state to the solid state.

The bar 12 or billet, usually rounded, begins to solidify in this part of the equipment and next continues to solidify toward the center in the ambient air with a movement exerted by an extraction system 10. Sometimes, some short movements in the direction opposite the extraction are possible to improve the quality of the surface of the billet. The bar 12 is then subjected to a magnetic stirring system 11 before the cutting equipment 13, which sections the bar 12 at the chosen length. It will be specified that several magnetic stirring systems can, if applicable, be used on the continuous casting line.

Furthermore, various means can be implemented depending on the alloy so as to ensure an absence of porosity related to the solidification (shrinkage or gas blow holes).

A first parameter, well known by those skilled in the art, is the casting temperature, which must be as close as possible to the solidification temperature, but compatible with industrial production. Overheating by 5 to 40° above the solidification temperature will be the rule, preferring, however, overheating by 10 to 15° C. This technique makes it possible to ensure good internal quality of the billet by reducing the shrinkage in the liquid metal. The water jets will be controlled to accelerate solidification while preventing crack formation on the surface.

Furthermore, the extraction speed and the extraction pitch outside the chill mold must be adapted to the cast alloy. The programming of the extraction speed can be complex, with stops and jolts, or even accelerations and braking. As an example, the extraction pitch for a round billet measuring 90 mm will be between 4 and 12 mm, and preferably around 7 to 8 mm. The extraction speed will be between 50 and 250 pitches per minute, and preferably around 150 pitches per minute.

Furthermore, magnetic stirrers can be placed in different locations to ensure the internal quality of the bar. Indeed, the solidification is of the dendritic type and develops from the surface initially in contact with the copper chill mold. Next, the dendrites continue to grow toward the center, and those corresponding to the bottom of the billet will grow more quickly due to gravity; temperature gradients may also form in the volume, not yet solidified, of the solidifying billet, which sometimes increases the risk of central defect. A first electromagnetic stirrer can be positioned around the chill mold, allowing a relatively low, but uniform casting temperature. A second stirrer can be positioned at the end of casting when the solidified thickness is about 20 mm. It allows, aside from homogenizing the temperature of the liquid metal, the removal of excessively long dendrites that could prevent obtaining the desired internal structure. As an example, for a billet with a diameter of 90 mm, the electromagnetic stirrer could be placed at a distance corresponding to the end of the solidification of said billet, or about 7 m from the chill mold.

Figure 2A:
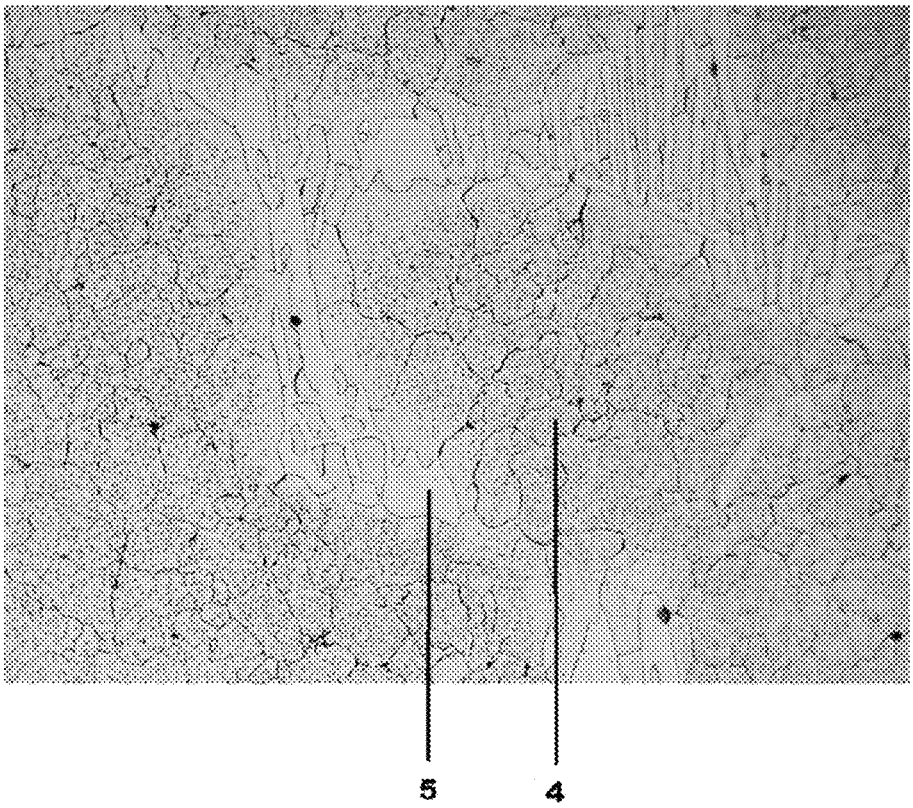
FIG.2A (Prior Art)
FIG. 2A is an optical metallography of a ball made from high chromium cast iron shaped by casting in a mold according to the prior art.
Figure 2B:
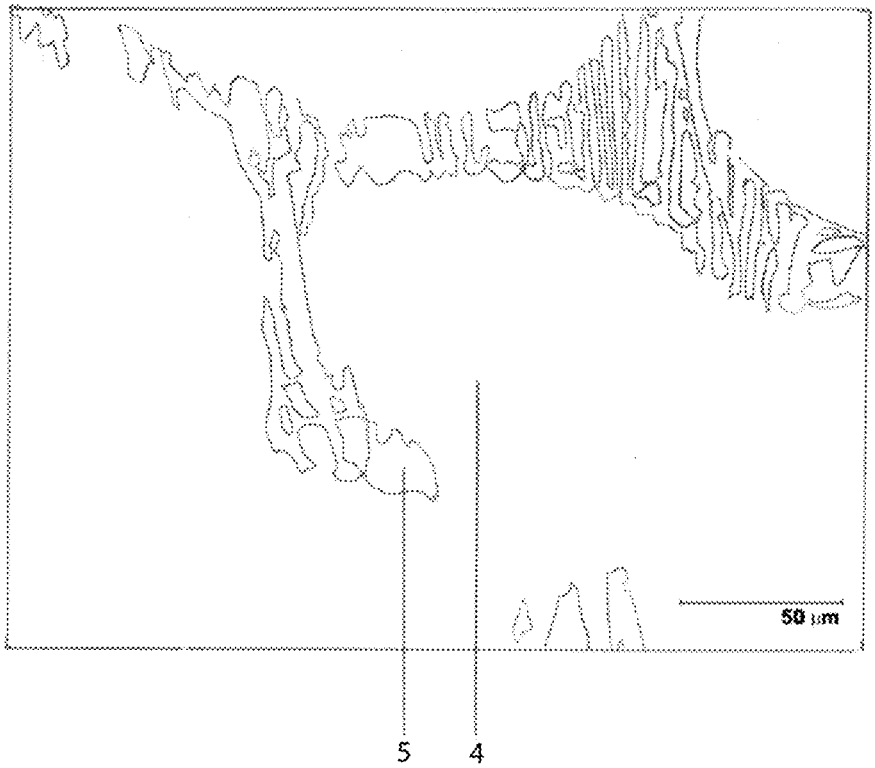
FIG. 2B (Prior Art)
FIG. 2B is a schematic illustration of the distribution of the carbides of FIG. 2A.
Figure 3A:
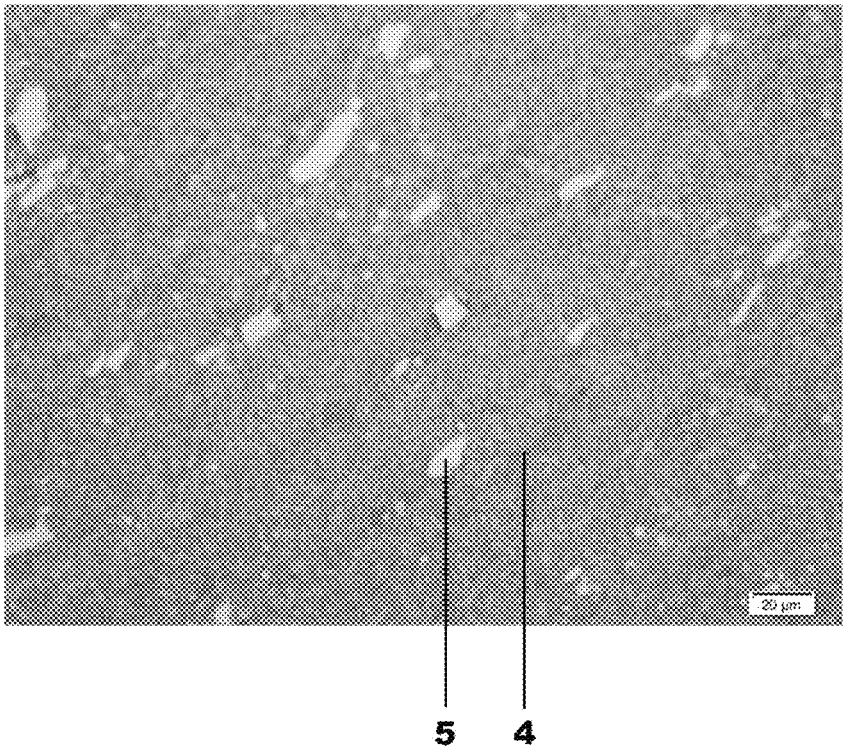
FIG. 3A shows two optical metallographies of a high chromium cast iron ball shaped by forging after continuous casting according to the present disclosure.
Figure 3A:
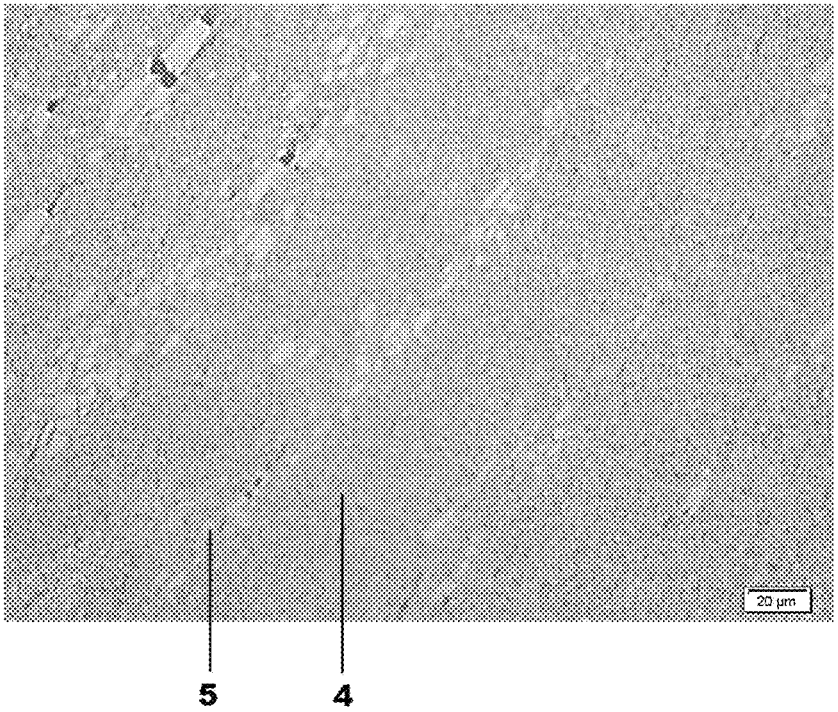
Figure 3B:
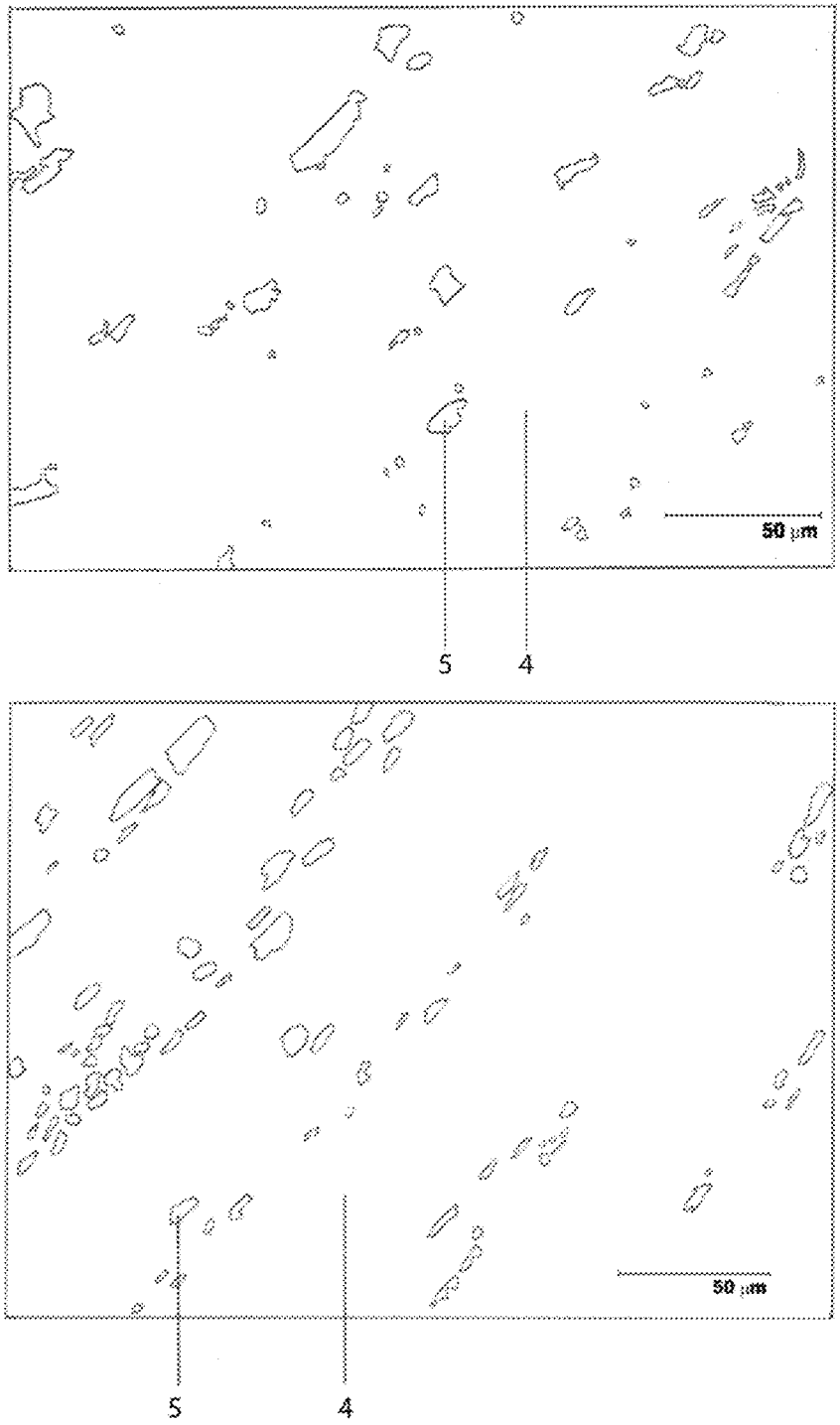
FIG. 3B is a schematic illustration of the distribution of the carbides of FIG. 3A.

At the end of the continuous casting step according to the present disclosure, the structure comprises a fine distribution of chromium carbides, called primary carbides, of the $M_7C_3$ type, which form during eutectic solidification. Two optical microscopies and the schematic representations thereof are given in FIGS. 3A and 3B (after forging), respectively. Unlike the solidification structures of the prior art for a high chromium cast iron cast to size in a mold (FIGS. 2A and 2B), the carbides 5 do not have the form of a network, but rather a discrete distribution within the matrix. These primary carbides, distributed periodically or, in other words, having a discrete distribution as opposed to a network distribution, impart improved abrasion resistance without deteriorating the impact resistance properties. It will be noted that the carbides can have a certain orientation that is given by the subsequent deformation steps.

Furthermore, the size of the solidification grain is reduced owing to the rapid and controlled solidification of the continuous casting step according to the present disclosure as well as the use of the magnetic stirrer(s). This grain fineness also contributes, but to a lesser extent, to the improved impact resistance.

Figure 4A:
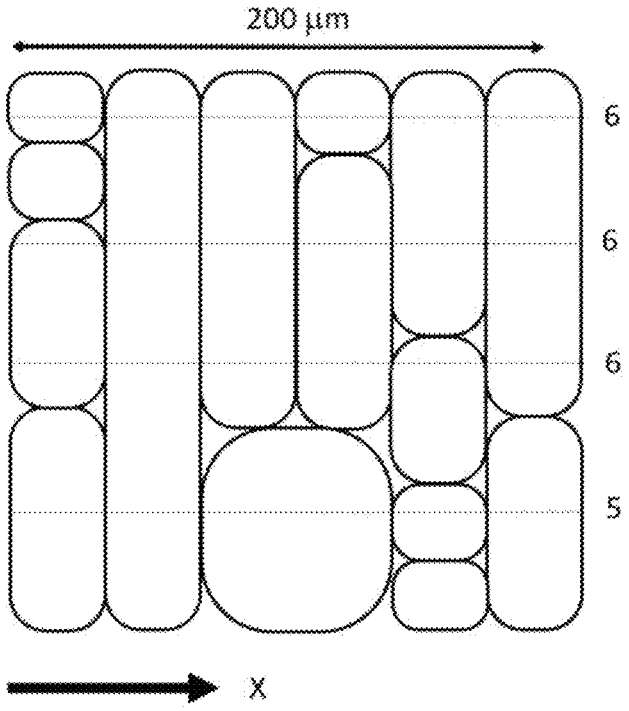
FIGS. 4A and 4B illustrate the method for measuring the number of grains measured respectively along the x-axis and the y-axis, allowing evaluation of the average grain size.
Figure 4B:
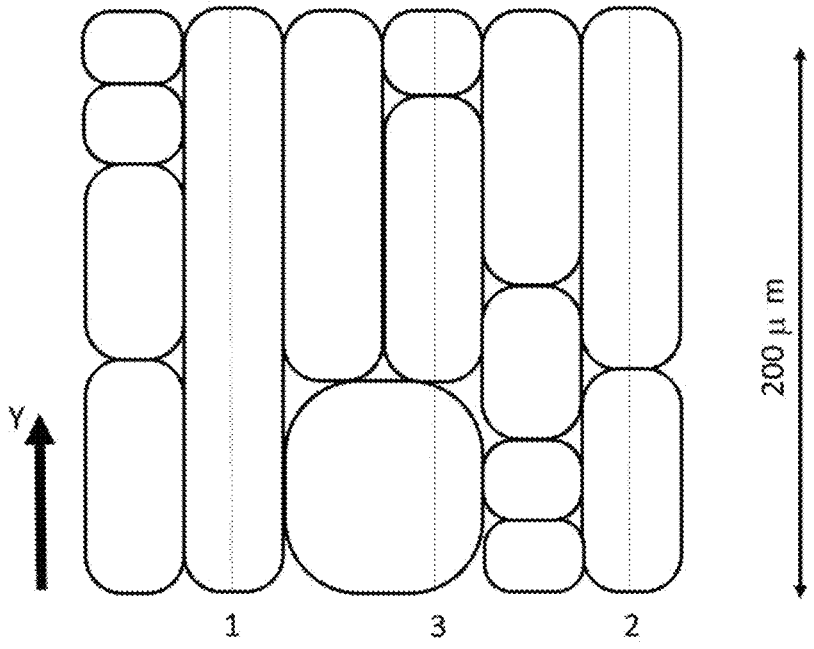

To evaluate the grain size, the interpolation method is used. For a known length, the number of grains passed through in the X direction is counted as described in FIG. 4A. A reference length is chosen arbitrarily, 200 μm for example. The figures on the right side give the number of intersections. This method is repeated in the other Y direction. In the illustrated example, a mean value of 35 μm is obtained in X and a mean value of 100 μm is obtained in Y, that is to say a general mean of 67 μm.

According to the present disclosure, for a bar having a diameter or a thickness greater than 85 mm, the solidification grain size is of less than 90 μm, preferably less than 80 μm and particularly preferably between 30 and 70 μm, especially in the first 15 millimeters below the surface, preferably 20 mm, or even 25 mm below the surface. In comparison, the grain size obtained by foundry casting in a sand mold is from 100 to 400 μm and from 100 to 200 μm in a metal mold.

Figure 6:
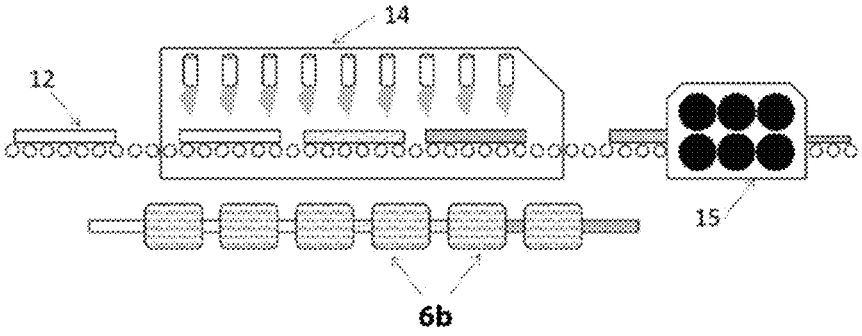
FIG. 6 schematically illustrates, as a continuation of FIG. 5, the optional step of rolling the bar obtained from the continuous casting.
Figure 7:
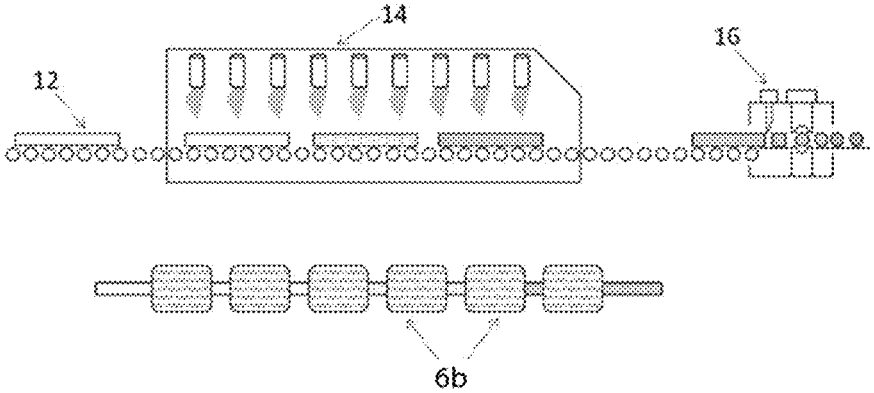
FIG. 7 schematically illustrates, as a continuation of FIG. 5 or FIG. 6, the step of forging the bar obtained from the continuous casting or the rolling.
Figure 8:
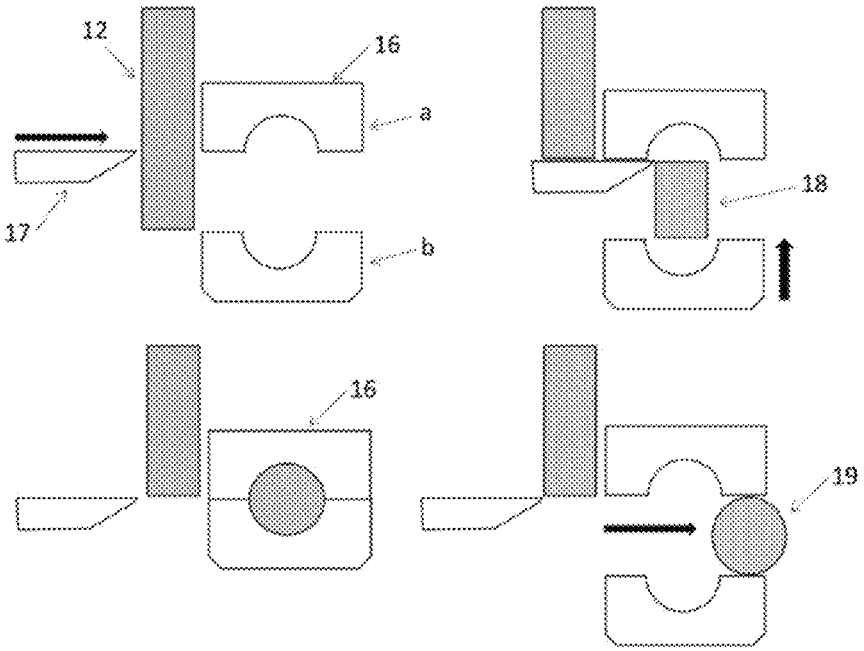
FIG. 8 illustrates the forging step in more detail.

After the continuous casting comes the shaping step, which can be done by rolling and/or forging. It is illustrated using FIGS. 6 to 8. It can be done by rolling in a series of grooved rollers gradually forming the ball. Most often, it is done by using a press 16 to forge a slug 18 cut in the bar 12 as illustrated in FIGS. 7 and 8. It may also be envisaged first to perform rolling to reduce the diameter of the bar as illustrated in FIG. 6, and then to shape the slugs obtained from the bar into ball form in the forging press. It may also be envisaged, following forging in the press, to perform a rolling step to perfect the sphericity of the ball coming out of the press.

During the optional rolling step in FIG. 6, the bar 12 is heated in a pusher-type furnace 14 or through a series of induction furnaces 6*b* in the austenitic range before being rolled in the rolling cages 15, to reduce the thickness of the bar and close any porosities. Next, the rolled bar 12 is heated again in these same types of furnaces 14, 6*b* in the austenitic range before being introduced into the forging press 16 (FIG. 7). Typically, the heating is done at a temperature comprised between 950 and 1250° C. The bar 12 is then cut by the knife 17 into a slug 18 that is introduced into the press 16 comprising, in the illustrated example, a stationary part 16*a* and a moving part 16*b*. The slug 18 is deformed into a blank having the shape of the ball 19 by the moving part 16*b*, which is moved toward the stationary part 16*a*. Optionally, as mentioned previously, the sphericity of the blank can next be improved by passing it through two cylinders having a shape close to an Archimedes screw.

The blank in ball form is then subject to a heat treatment in one or several cycles to obtain the final product. There is a first austenitizing and quenching cycle intended to form the primarily martensitic microstructure. The austenitizing is done in a temperature range comprised between 880 and 1075° C. for a time period of between 30 minutes and 3 hours. Optionally, this cycle can be done in several stages with the first stage for keeping the temperature at between 620 and 730° C. for a time period of between 15 minutes and two hours, followed by a second stage for keeping the temperature at between 880 and 1075° C. for a time period of between 30 minutes and 3 hours. Next, the blank undergoes quenching to a temperature of less than 220° C. so as to form martensite. The quenching can be done in oil, water, blown air, a polymer, etc. This austenitizing, quenching cycle can be followed by stress-relieving temper at a temperature comprised between 150 and 400° C. for a time period of between 30 minutes and 6 hours. This stress-relieving temper is intended to slightly reduce the internal tensions generated by the transformation of the austenite into martensite.

It will be specified that the method described above can be done continuously so as to avoid or at least limit the heating phases between the casting and the shaping, for example, or between the shaping and the heat treatment.

At the end of the manufacturing method, a microstructure is obtained with a matrix comprising a percentage of martensite greater than 50%, preferably between 60 and 80%, a percentage of residual austenite comprised between 7 and 25%, and preferably between 10 and 20%, and a fraction of perlite and bainite comprised between 2 and 10% in total. Aside from the aforementioned structures, the microstructure comprises primary carbides distributed in the matrix and optionally several secondary carbides of the $M_{23}C_6$ type, formed during the heat treatment cycles. The microstructure thus comprises, for a total percentage of 100%, the aforementioned structures with a balance made up of chromium carbides with a percentage that may reach 22%. The residual austenite fraction is measured by RX diffraction according to standard ASTM E975-13 and the fractions of the other phases are measured by image analysis. The final properties are a hardness from 54 to 65 Rc and more generally close to 60 Rc, the Rockwell C hardness being measured according to standard ISO6508-1:2016.

The grinding balls according to the present disclosure thus have an excellent wear resistance imparted in a known manner by the high hardness of the alloy obtained owing to the presence of martensite and chromium carbides. However, surprisingly, this excellent wear resistance is combined with very good impact resistance properties owing to the fine primary carbide distribution as well as the reduced size of the solidification grains.

The impact resistance properties were tested and compared with those of grinding balls made from high chromium cast iron shaped by casting according to the prior art. The test is based on a technical article by the US Bureau of Mines (R. Blickensderfer and J. H. Tylczak, *Minerals & Metallurgical processing*, May 1989, pp. 60-66). The test consists in allowing, for each of the two types of balls, 46 balls with a diameter of 125 mm to fall from a height of 10 m. The test is performed per cycle with each of the balls released successively and then re-integrated into the loop to be released again. The balls are weighed regularly. If the weight loss is greater than 50%, the test is stopped. For a carbon steel shaped by forging, the base specification is at least 60,000 impacts. For grinding balls made from high chromium cast iron shaped by casting, the test was stopped after 47,000 impacts, which is a mediocre result. For grinding balls of the same composition shaped by forging according to the present disclosure, the ceiling of 200,000 impacts was exceeded without reaching the weight loss criterion of 50%.

The grinding balls according to the present disclosure thus have excellent wear resistance with impact resistance properties at least equal to those of conventional forged carbon steels.

The invention claimed is:

1. A grinding ball, wherein the grinding ball prior to use comprises, by weight:

a carbon content comprised between 1.1 and 1.4%, a chromium content comprised between 10 and 14%, a manganese content comprised between 0.8 and 1.5%, a silicon content comprised between 0.6 and 1%, a molybdenum content of less than 1%, a nickel content of less than 1%, manufacturing impurities with a total content of less than 0.5%, the balance to obtain 100% being iron, wherein the grinding ball comprises a discrete distribution of chromium carbides, and wherein the grinding ball has a microstructure comprising a martensite percentage greater than 50% by volume, a residual austenite percentage between 7 and 25% by volume, a total percentage of perlite and bainite between 2 and 10% by volume, and a chromium carbide percentage of greater than 0% and less than or equal to 22% by volume.

2. The grinding ball according to claim 1, wherein, by weight:

the carbon content is 1.2%, the chromium content is 12%, the manganese content is 1.1%, and the silicon content is 0.8%.

3. The grinding ball according to claim 1, wherein the carbon content by weight and the chromium content by weight correspond to the following relations:

$$2.55 \leq \text{the chromium content} - 5.42 * \text{the carbon content} \leq 7.67 \text{ and}$$

$$41.76 \leq \text{the chromium content} + 28.66 * \text{the carbon content} \leq 53.69.$$

4. The grinding ball according to claim 1, wherein the chromium carbides have an equivalent diameter of less than 100 μm.

5. The grinding ball according to claim 1, wherein the martensite percentage is between 60 and 80% by volume, the residual austenite percentage is between 10 and 20% by volume, and the total percentage of perlite and bainite is between 2 and 10% by volume.

6. The grinding ball according to claim 1, wherein the grinding ball has a Rockwell C hardness comprised between 54 and 64.

7. The grinding ball according to claim 1, wherein the grinding ball has a diameter comprised between 90 mm and 150 mm.

8. The grinding ball according to claim 4, wherein the equivalent diameter of the chromium carbides is less than 50 μm.

9. The grinding ball according to claim 4, wherein the equivalent diameter of the chromium carbides is less than 20 μm.

* * * * *